US005462046A

United States Patent [19]

Hannah

[11] Patent Number: 5,462,046

[45] Date of Patent: Oct. 31, 1995

[54] FIREPLACE LOG DISPENSING APPARATUS

[76] Inventor: Jacquilyn K. Hannah, 5690 Hwy. 166, Douglasville, Ga. 30135

[21] Appl. No.: 231,496

[22] Filed: Apr. 22, 1994

[51] Int. Cl.[6] ..... F24B 1/199

[52] U.S. Cl. ..... 126/501; 110/101 CF; 110/101 C; 110/101 R; 126/500

[58] Field of Search ..... 126/500, 501, 126/7, 10, 73, 68, 107, 222, 224, 540; 110/191, 192, 101 CC, 108, 101 C, 101 CF, 106, 293, 294, 275, 276, 117

[56] References Cited

U.S. PATENT DOCUMENTS

| | | | |
|---|---|---|---|
| 742,198 | 10/1903 | Josten . | |
| 1,335,265 | 3/1920 | Zamernik | 110/101 CC |
| 1,804,988 | 5/1931 | Howe | 126/501 X |
| 2,454,400 | 11/1948 | Norman | 110/293 X |
| 4,307,700 | 12/1981 | Michael | 126/68 |
| 4,329,931 | 5/1982 | Burton | 110/255 X |
| 4,339,998 | 7/1982 | Finch | 110/101 CC X |
| 4,442,825 | 4/1984 | Woldau | 126/68 |
| 4,444,538 | 4/1984 | Manley | 126/501 |
| 4,474,396 | 10/1984 | Dennis | 294/11 |
| 4,539,915 | 9/1985 | Bouron | 110/101 C X |
| 4,828,485 | 5/1989 | Jankowski | 126/512 |
| 4,838,781 | 6/1989 | Fischer | 431/125 |
| 4,924,564 | 5/1990 | Shah | 126/512 |
| 4,962,750 | 10/1990 | Bridgewater | 126/512 |
| 5,009,217 | 4/1991 | Johnson | 126/152 B |

FOREIGN PATENT DOCUMENTS

| | | | |
|---|---|---|---|
| 2444892 | 8/1980 | France | 126/73 |
| 2668581 | 4/1992 | France | 126/73 |
| 0846917 | 7/1981 | U.S.S.R. | 110/293 |

*Primary Examiner*—Carl D. Price

[57] ABSTRACT

A new and improved fireplace log dispensing apparatus includes a gravity feed chute assembly for receiving a plurality of logs to be burned in a fireplace, and a log dispenser assembly, connected at a bottom of the gravity feed chute assembly, for selectively dispensing logs into the fireplace, preferably onto a grate in the fireplace. The gravity feed chute assembly includes a queue-forming assembly for arranging the plurality of logs into a queue. The log dispenser assembly dispenses one log at a time from the queue onto the fireplace grate. More specifically, the log dispenser assembly includes a number of movable partitions and a stationary wall which define a sequestering chamber for isolating one log at a time from the queue and for moving the isolated log onto the fireplace grate. The movable partitions are in the form of vanes arrayed radially around a central shaft which rotates on bearings. The movable partitions are driven by weight of the queue of logs. Movement of the movable partitions is controlled by an incremental stop assembly which includes a plurality of stop elements that are equal in number to the number of the movable partitions. A lock assembly is provided for engaging with the stop elements.

19 Claims, 4 Drawing Sheets

FIREPLACE LOG DISPENSING APPARATUS

BACKGROUND OF THE INVENTION

1. Field of the Invention

The present invention relates generally to fireplaces, and more particularly, to a device especially adapted for supplying logs to a fire in a fireplace.

2. Description of the Prior Art

Fireplaces have been a popular source of heating rooms for many years. Many innovations have been devised over the years to facilitate the use of fireplaces. For example, the following U.S. patents in the prior art disclose devices which aid in the use of fireplaces: U.S. Pat. Nos. 4,474,396; 4,828,485; 4,838,781; and 5,009,217. More specifically, U.S. Pat. No. 4,474,396 discloses a log handler for a fireplace which picks up logs and thrusts them into the fireplace. U.S. Pat. No. 4,828,485 discloses a specific fireplace burner apparatus. U.S. Pat. No. 4,838,781 discloses an insert for a fireplace that includes a burner unit and simulated logs. U.S. Pat. No. 5,009,217 discloses a fireplace log holder which includes an audible alarm which signals a dangerous condition of log shifting in a burning fire.

An important aspect of fireplaces is not satisfactorily addressed by the prior art cited above. That is, in order to add a log to the fire, one must literally carry a log to the fire and place it on the burning fire. In this respect, one must remove a fire screen to add the log. Then one must replace the fire screen after the log is added. In this respect, it would be desirable if a device were provided that precluded the need for a person to carry a log and place it by hand on a burning fire. In addition, it would be desirable if a device were provided which avoided the necessity of removing and replacing a fire screen each time a new log is added to the fire.

Often a person enjoys looking at a burning fire and enjoys feeling its warmth from a cuddled up position on a chair or sofa. Often the person seeks a comfortable position on the chair or sofa, and the person would prefer not to move from a comfortable position to add another log on the fire. In this respect, it would be desirable if a device were provided by which a person could have a log added to the fire without the person giving up a position of comfort on a chair or sofa.

Often a level of burning is maintained in the fireplace so that addition of another log is required at predictable time intervals. For example, a fire can be maintained and controlled so that a new log needs to be added every half hour. The necessity for a person to keep tending the fire on such a periodic basis can be annoying and undesirably time consuming. In this respect, it would be desirable if a device were provided by which a log could be added automatically to the fireplace at predetermined periodic intervals.

Thus, while the foregoing body of prior art indicates it to be well known to use various devices for keeping a fire going in a fireplace, the prior art described above does not teach or suggest a fireplace log dispensing apparatus which has the following combination of desirable features: (1) precludes the need for a person to carry a log and place it by hand on a burning fire; (2) avoids the necessity of removing and replacing a fire screen each time a new log is added to the fire; (3) adds a log automatically to the fireplace at predetermined periodic intervals; and (4) adds a log to the fire without the person giving up a position of comfort on a chair or sofa. The foregoing desired characteristics are provided by the unique fireplace log dispensing apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved fireplace log dispensing apparatus which includes a gravity feed chute assembly for receiving a plurality of logs to be burned in a fireplace, and a log dispenser assembly, connected at a bottom of the gravity feed chute assembly, for selectively dispensing logs into the fireplace, preferably onto a grate in the fireplace. The gravity feed chute assembly includes a queue-forming assembly for arranging the plurality of logs into a queue. The log dispenser assembly dispenses one log at a time from the queue onto the fireplace grate. More specifically, the log dispenser assembly includes a number of movable partitions and a stationary wall which define a sequestering chamber for isolating one log at a time from the queue and for moving the isolated log onto the fireplace grate. The movable partitions are in the form of vanes arrayed radially around a central shaft which rotates on bearings. The movable partitions are driven by weight of the queue of logs. Movement of the movable partitions is controlled by an incremental stop assembly which includes a plurality of stop elements that are equal in number to the number of the movable partitions. A lock assembly is provided for engaging with the stop elements. The stop elements are arrayed at equal intervals on a stop element drum. More specifically, four movable partitions are arrayed at approximately 90 degree intervals around the central shaft; and tour stop elements are arrayed at approximately 90 degree intervals around the stop element drum. The lock assembly includes a spring-loaded locking pin for sequentially engaging with the stop elements and locking therewith.

The spring-loaded locking pin may be either manually operated or operated by an electric motor. A remote control assembly may be employed for controlling the electric motor for operating the spring-loaded locking pin of the lock assembly. The remote control assembly includes a battery-powered transmitter unit and an AC powered receiver unit. The receiver unit includes a switch for actuating the electric motor for disengaging the spring-loaded locking pin of the lock assembly. The switch includes a solenoid-operated switch. The electric motor drives a rotatable cam for operating the spring-loaded locking pin of the lock assembly. A timer unit is controlled by the receiver unit; and the timer unit controls the solenoid-operated switch which actuates the electric motor to disengage the spring-loaded locking pin from the stop element to permit a log to be added from the queue to the fireplace. The time unit can be set to cycle periodically for automatically controlling addition of a log to the fireplace at timed intervals.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved fireplace log dispensing apparatus which has all of the advantages of the prior art and none of the disadvantages.

It is another object of the present invention to provide a new and improved fireplace log dispensing apparatus which may be easily and efficiently manufactured and marketed.

It is a further object of the present invention to provide a new and improved fireplace log dispensing apparatus which is of durable and reliable construction.

An even further object of the present invention is to provide a new and improved fireplace log dispensing apparatus which is susceptible of a low cost of manufacture with regard to both materials and labor, and which accordingly is then susceptible of low prices of sale to the consuming public, thereby making such fireplace log dispensing apparatus available to the buying public.

Still yet a further object of the present invention is to provide a new and improved fireplace log dispensing apparatus which precludes the need for a person to carry a log and place it by hand on a burning fire.

Still another object of the present invention is to provide a new and improved fireplace log dispensing apparatus which avoids the necessity of removing and replacing a fire screen each time a new log is added to the fire.

Yet another object of the present invention is to provide a new and improved fireplace log dispensing apparatus which adds a log automatically to the fireplace at predetermined periodic intervals.

Even another object of the present invention is to provide a new and improved fireplace log dispensing apparatus that adds a log to a fire without a person giving up a position of comfort on a chair or sofa.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 2:
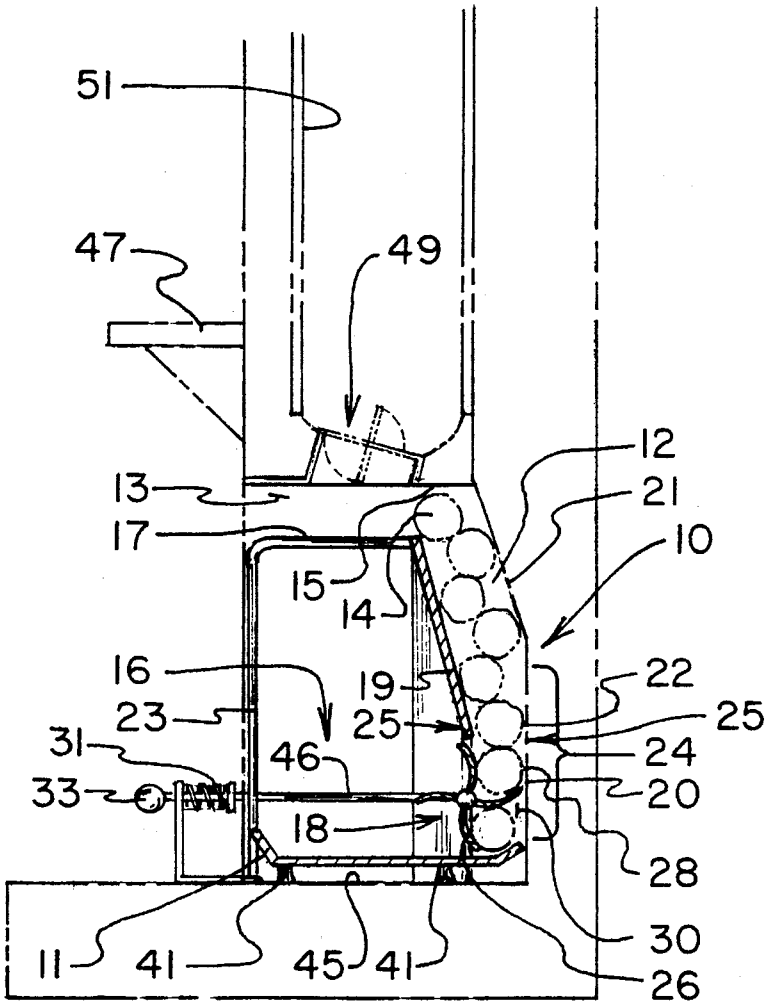
FIG. 2 is a cross-sectional view of the fireplace log dispensing apparatus along line 2—2 of FIG. 1.
Figure 1:
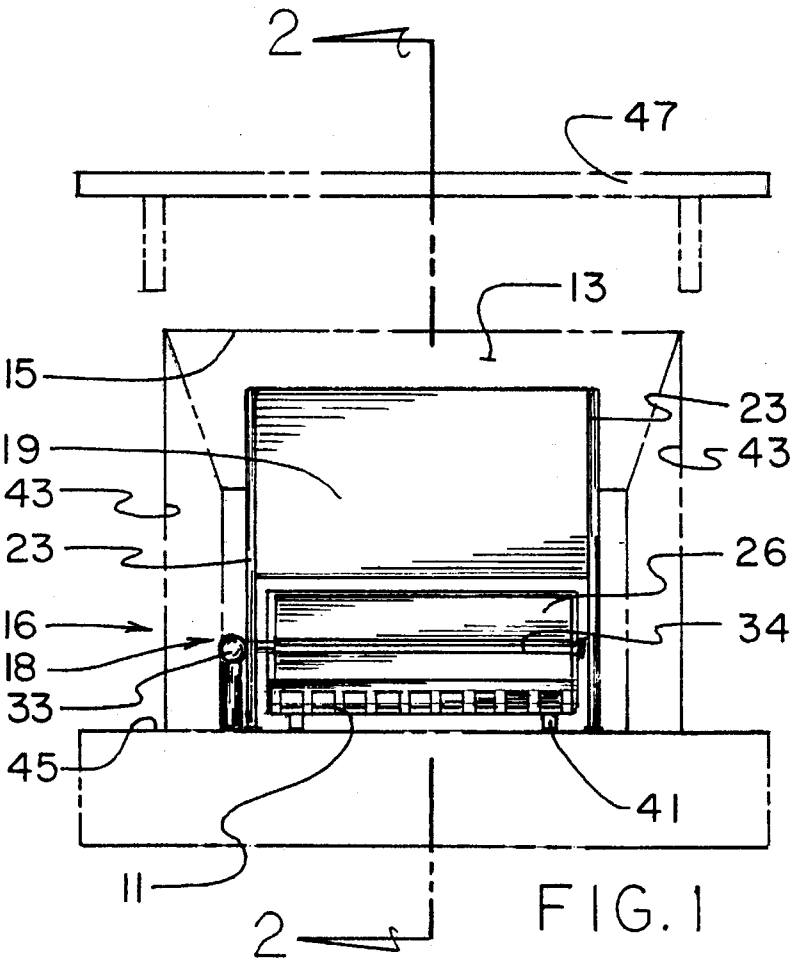
FIG. 1 is a front view showing a first preferred embodiment of the fireplace log dispensing apparatus of the invention.
Figures 3, 4:
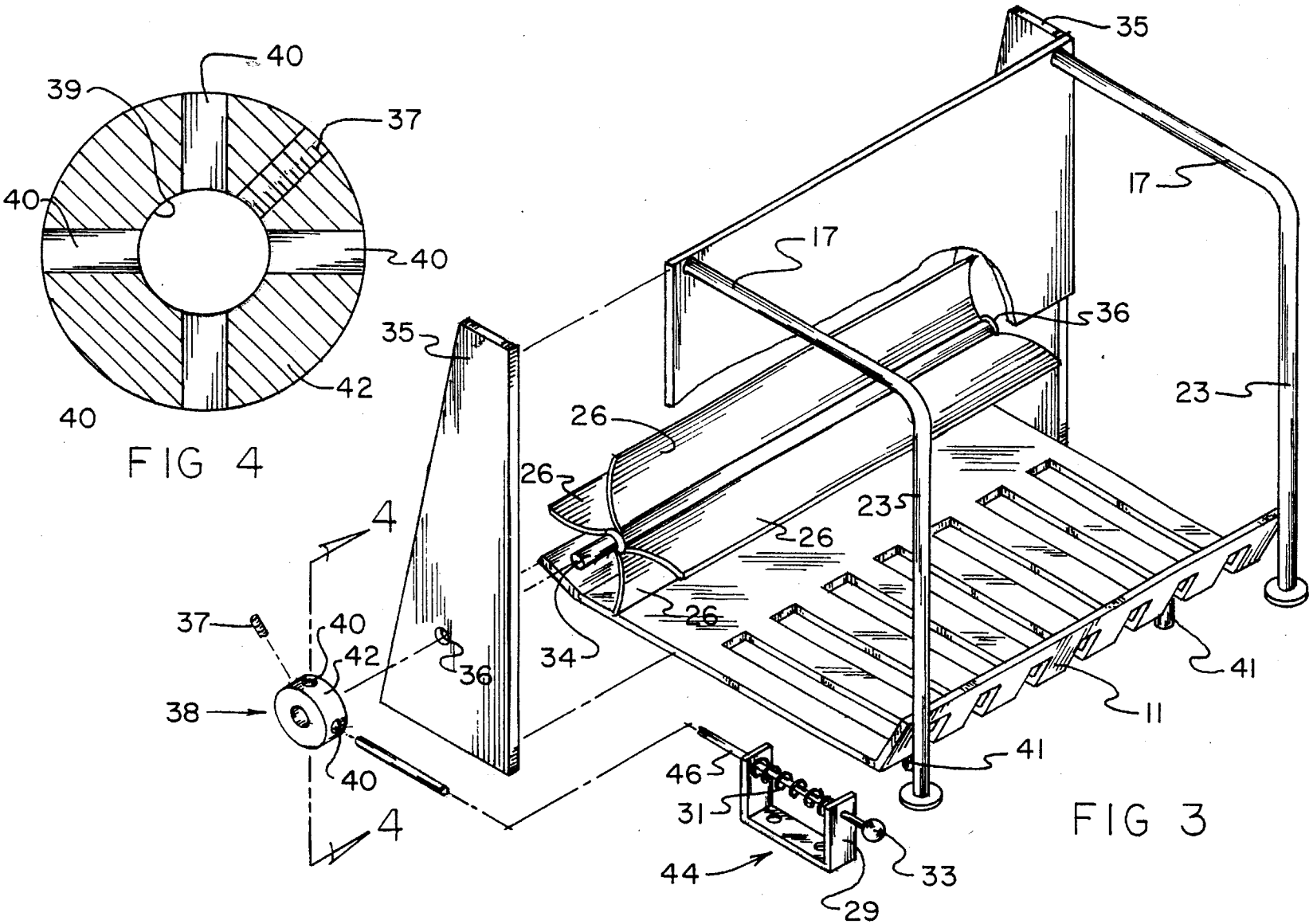
FIG. 3 is an enlarged, partially exploded, partial perspective view of the fireplace log dispensing apparatus of FIG. 2.
FIG. 4 is a cross-sectional view of a stop element drum having four stop elements arrayed in 90 degree intervals around a center of the drum.
Figure 5:
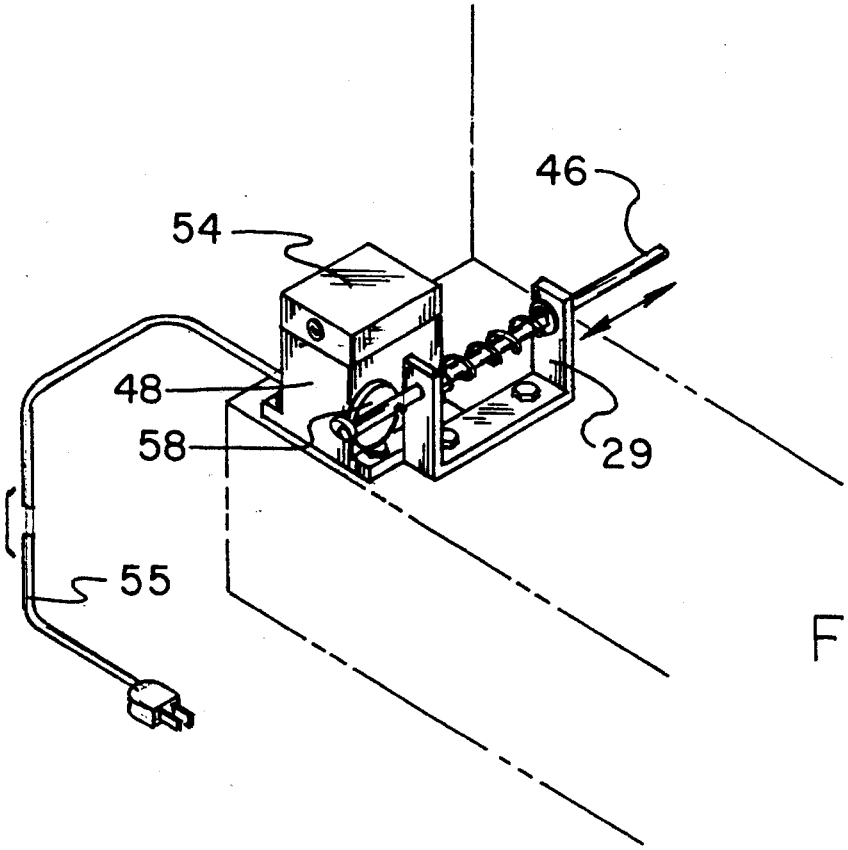
FIG. 5 is a perspective view of a receiver unit of a second preferred embodiment of the invention which employs remote control for dispensing logs.
Figure 6:
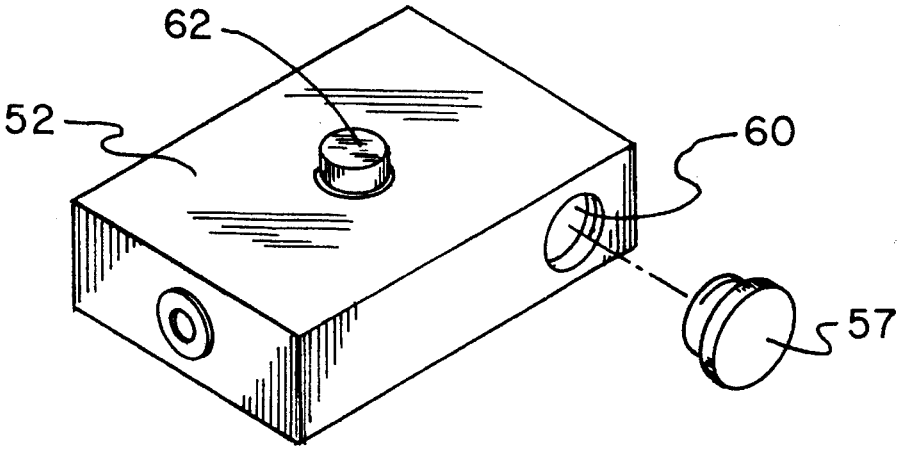
FIG. 6 is a perspective view of a battery-powered, portable transmitter unit used to remotely activate the receiver unit shown in FIG. 5.
Figure 7:
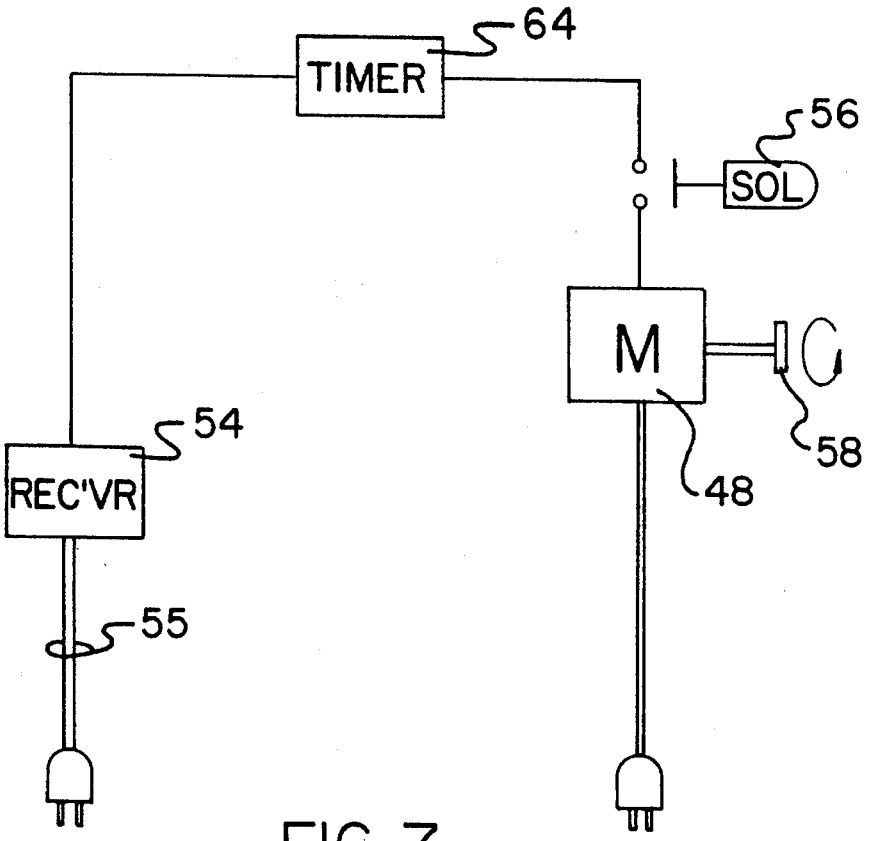
FIG. 7 is an electrical block diagram of circuitry for the receiver unit shown in FIG. 5.
Figure 8:
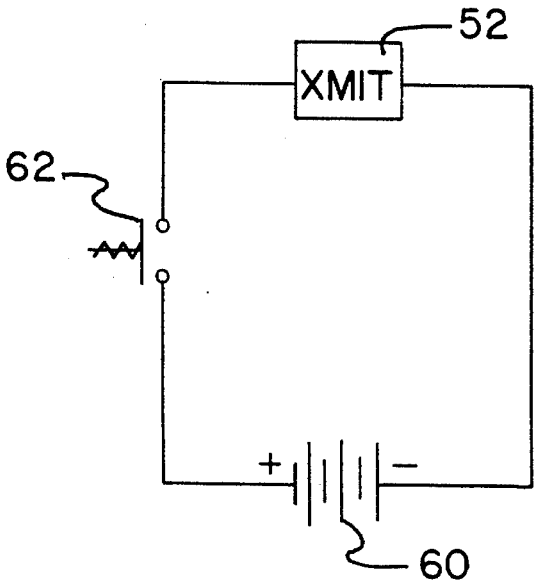
FIG. 8 is an electrical block diagram of circuitry for the transmitter unit shown in FIG. 6.

With reference to the drawings, a new and improved fireplace log dispensing apparatus embodying the principles and concepts of the present invention will be described.

Turning initially to FIGS. 1–4, there is shown a first exemplary embodiment of the fireplace log dispensing apparatus of the invention generally designated by reference numeral 10. In its preferred form, logs 14 are placed in opening 13 which is a space between the ceiling 15 of the fireplace 16 and the top of a pair of horizontal rails 17 which serves as a support for logs 14 added to the gravity feed chute assembly 12 which receives a plurality of logs 14 to be burned in the fireplace 16. The fireplace 16 includes conventional features such as a ceiling 15, a back wall 21, side walls 43, a floor 45, a mantle piece 47, a draft valve 49, and a chimney 51.

Horizontal rails 17, supported by vertical legs 23, are connected to the gravity feed chute assembly 12 for feeding logs 14 into the gravity feed chute assembly 12. A log grate 11 is connected to the gravity feed chute assembly 12 and to the vertical legs 23. The gravity feed chute assembly 12 includes a front wall 19 which is connected to the horizontal rails 17. The front wall 19 serves as a fire protection wall to prevent the supply of logs 14 from being burned by the fire (not shown) in the fireplace 16. The front wall 19 and a rear wall 21 of the fireplace 16 define a space forming the gravity feed chute assembly 12. A log dispenser assembly 18 is connected at the bottom 20 of the gravity feed chute assembly 12 and selectively dispenses logs 14 onto the log grate 11. The log grate 11 has feet 41 which keep the log grate 11 above the floor of the fireplace 16.

The gravity feed chute assembly 12 includes a queue-forming assembly 22 for arranging a plurality of logs 14 in a queue 24. The log dispenser assembly 18 dispenses one log 14 at a time from the queue 24 onto the log grate 11. More specifically, the queue 24 is formed by a narrowing of a throat 25 in the gravity feed chute assembly 12. The narrowing of the throat 25 in the gravity feed chute assembly 12 is brought about by a narrowing of the distance between the rear wall 21 of the fireplace 16 and the front wall 19 of the gravity feed chute assembly 12.

The log dispenser assembly 18 includes a number of movable partitions 26 and a stationary wall 28 which define a sequestering chamber 30 for isolating one log 14 from the queue 24 of logs 14 and for :moving the isolated log 14 into the fireplace 16. The movable partitions 26 are in the form of vanes 26 arrayed radially around a central shaft 34 which rotates on bearing surfaces 36 which are retained in side walls 35 of the gravity feed chute assembly 12. The side walls 35 are connected to the front wall 19 and the log grate 11. The movable partitions 26 are driven by weight of the queue 24 of logs 14 on the partitions 26. As shown in FIG. 2, two movable partitions 26 are oriented vertically and extend the effective length of the front wall 19 to the floor of the log grate 11. In this respect, the movable partitions 26 serve to protect logs 14 in the queue 24 from fire in the fireplace 16 until the logs are dispensed onto the front portion of the log grate 11 where the burning fire is present. As the movable partitions 26 are turned, they effectively sweep a log 14 from the queue 24 to the fire on the grate 11.

Movement of the movable partitions 26 is controlled by an incremental stop assembly 38 which includes a plurality of stop elements 40 that are equal in number to the number of the movable partitions 26 and which includes a lock assembly 44 for engaging with the stop elements 40. The stop elements 40 are arrayed at equal intervals on a stop element drum 42 which has a central aperture 39 for receiving central shaft 34. Four movable partitions 26 are arrayed at approximately 90 degree intervals around the central shaft 34. Four stop elements 40 are arrayed at approximately 90 degree intervals around the stop element drum 42. A lock screw 37 is loosened to permit calibration between the stop elements 40 on the stop element drum 42 and the movable partitions 26 on the central shaft 34. Once proper calibration is obtained, the lock screw 37 is retightened.

The lock assembly 44 includes a spring-loaded locking pin 46 for sequentially engaging with the stop elements 40 and locking therewith. The spring-loaded locking pin 46 is supported by a bracket 29 and has a spring 31 and a handle 33. The spring-loaded locking pin 46 can be either manually operated or may be operated by an electric motor 48.

The following components of the fireplace log dispensing apparatus 10 of the invention can be made as a unified structure and sold as a modular unit for placement into a fireplace 16: vertical legs 23, horizontal rails 17, fire protection wall 19, movable partitions 26, central shaft 34, side walls 35, bearing surfaces 36, log grate 11, feet 41, spring-loaded locking pin 46, spring 31, bracket 29, stop element drum 42, stop elements 40, and locking screw 37.

Turning to FIGS. 5–8, a second embodiment of the invention is shown. Reference numerals are shown that correspond to like reference numerals that designate like elements shown in the other figures. In addition, a remote control assembly is used for controlling the electric motor 48 and for operating the spring-loaded locking pin 46 of the lock assembly 44. The remote control assembly includes a transmitter unit 52 and a receiver unit 54, wherein the receiver unit 54 includes a switch assembly 56 for actuating the electric motor 48 for disengaging the spring-loaded locking pin 46 of the lock assembly 44. The switch assembly 56 includes a solenoid-operated switch 56.

In addition, a timer unit 64 is controlled by the receiver unit 54. The timer unit 64 controls the solenoid-operated switch 56 for actuating the electric motor 48. The electric motor 48 drives a rotatable cam 58 for operating the spring-loaded locking pin 46 of the lock assembly 44 to disengage the spring-loaded locking pin 46 from the stop element 40 to permit the log dispenser assembly 18 to add a log 14 from the queue 24 to the fireplace 16. The timer unit 64 can be programmed or otherwise set to actuate the solenoid-operated switch 56 at timed intervals, such as every half hour. In this way, a log 14 can be added to the fireplace 16 automatically every half hour.

The transmitter unit 52 is powered by batteries 60 and includes and on/off switch 62. A cap 57 is used to secure the batteries 60 in a battery chamber. When the on/off switch 62 is pressed remotely by a user, the receiver unit 54 is actuated remotely. The receiver unit 54 is powered by AC power through power cord 55.

The medium for communication between the transmitter unit 52 and the receiver unit 54 can be electromagnetic radiation or sound energy, as desired.

The components of the fireplace log dispensing apparatus of the invention can be made from inexpensive and durable metal materials. Readily available transmitter and receiving equipment can also be employed.

The embodiments of the fireplace log dispensing apparatus described above relate to a fireplace log dispensing apparatus that receives logs from the from of the front side of the fire place. Alternatively, logs may be added to the gravity feed chute assembly by a side opening in a fireplace wall.

In addition, the embodiments of the fireplace log dispensing apparatus described above relate to a fireplace log dispensing apparatus that employs a plurality of rotatable vanes for sweeping a log from the queue to the fire burning area of the grate. Alternatively, a log from the queue can be pushed from the queue into the fire burning area of the grate. More specifically, a push rod, similar in function to a push rod on a pin ball machine, can push a log into the fire burning area of the grate.

It is apparent from the above that the present invention accomplishes all of the objects set forth by providing a new and improved fireplace log dispensing apparatus that is low in cost, relatively simple in design and operation, and which may advantageously be used to preclude the need for a person to carry a log and place it by hand on a burning fire. Also, with the invention, the necessity of removing and replacing a fire screen each time a new log is added to the fire is avoided. With the invention, a log can be added automatically to the fireplace at predetermined periodic intervals. With the invention, a log can be added to the fire without the person giving up a position of comfort on a chair or sofa.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

I claim:

1. A new and improved fireplace log dispensing apparatus, comprising:

gravity feed chute assembly means for receiving a plurality of logs to be burned in a fireplace, log dispenser assembly means, connected at a bottom of said gravity feed chute assembly means, for selectively dispensing logs into the fireplace, horizontal rails, supported by vertical legs, connected to said gravity feed chute assembly means for feeding logs into said gravity feed chute assembly means, and a log grate connected to said gravity feed chute assembly means and to said vertical legs, wherein said gravity feed chute assembly means include a front fire protection wall which is connected to said horizontal rails and which protects the logs from being burned by a fire in the fireplace, wherein said front wall and a rear wall of the fireplace define a space forming said gravity feed chute assembly, and wherein said log dispenser assembly means, connected at a bottom of said gravity feed chute assembly means, selectively dispenses logs onto said log grate for burning in a fire in the fireplace.

2. The apparatus described in claim 1 wherein:

said gravity feed chute assembly means include queue-forming assembly means for arranging a plurality of logs in a queue, and said log dispenser assembly means dispense one log at a time from said queue into the fireplace.

3. The apparatus described in claim 1 wherein said log dispenser assembly means include a number of movable partitions and a stationary wall which define a sequestering chamber for isolating one log from said queue of logs and for moving the isolated log into the fireplace.

4. The apparatus described in claim 3 wherein said movable partitions are in the form of vanes arrayed radially around a central shaft which rotates on bearings.

5. The apparatus described in claim 3 wherein said movable partitions are driven by weight of said queue of logs.

6. The apparatus described in claim 3 wherein movement of said movable partitions is controlled by an incremental stop assembly which includes a plurality of stop elements that are equal in number to the number of said movable partitions and which includes a lock assembly for engaging with said stop elements.

7. The apparatus described in claim 6 wherein said stop elements are arrayed at equal intervals on a stop element drum.

8. The apparatus described in claim 7 wherein:

four movable partitions are arrayed at approximately degree intervals around said central shaft, four stop elements are arrayed at approximately degree intervals around said stop element drum, and said lock assembly includes a spring-loaded locking pin for sequentially engaging with said stop elements and locking therewith.

9. The apparatus described in claim 8 wherein said spring-loaded locking pin is manually operated.

10. The apparatus described in claim 8 wherein said spring-loaded locking pin is operated by an electric motor.

11. The apparatus described in claim 1 wherein:

the fireplace includes a log grate, said log dispenser assembly means selectively dispenses logs into the log grate.

12. The apparatus described in claim 1 further including remote control assembly means for controlling said electric motor, for operating said spring-loaded locking pin of said lock assembly.

13. The apparatus described in claim 12 wherein said remote control assembly means include a transmitter unit a receiver unit, wherein said receiver unit includes switch means for actuating said electric motor for disengaging said spring-loaded locking pin of said lock assembly.

14. The apparatus described in claim 13 wherein said switch means include a solenoid-operated switch.

15. The apparatus described in claim 12, further including a timer unit controlled by said receiver unit, wherein said timer unit controls said solenoid-operated switch which actuates said electric motor to disengage said spring-loaded locking pin from said stop element to permit a log to be added from said queue to the fireplace.

16. The apparatus described in claim 12 wherein said transmitter unit is powered by batteries and includes and on/off switch.

17. The apparatus described in claim 12 wherein said receiver unit is powered by AC power.

18. The apparatus described in claim 12 wherein said electric motor drives a rotatable cam for operating said spring-loaded locking pin of said lock assembly.

19. A new and improved fireplace log dispensing apparatus, comprising:

gravity feed chute assembly means for receiving a plurality of logs to be burned in a fireplace, horizontal rails, supported by vertical legs, connected to said gravity feed chute assembly means for feeding logs into said gravity feed chute assembly means, a log grate connected to said gravity feed chute assembly means and to said vertical legs, log dispenser assembly means, connected at a bottom of said gravity feed chute assembly means, selectively dispenses logs onto said log grate for burning in a fire in the fireplace, wherein said gravity feed chute assembly means include a front fire protection wall which is connected to said horizontal rails and which protects the logs from being burned by a fire in the fireplace, and wherein said front wall and a rear wall of the fireplace define a space forming said gravity feed chute assembly.

* * * * *